US007032428B2

(12) United States Patent
Miyaura

(10) Patent No.: US 7,032,428 B2
(45) Date of Patent: Apr. 25, 2006

(54) FEEDING UNIT FOR TRANSFER PRESS

(75) Inventor: Makoto Miyaura, Komatsu (JP)

(73) Assignee: Komatsu, Ltd., (JP)

( * ) Notice: Subject to any disclaimer, the term of this patent is extended or adjusted under 35 U.S.C. 154(b) by 64 days.

(21) Appl. No.: 10/770,425

(22) Filed: Feb. 4, 2004

(65) Prior Publication Data

US 2004/0159139 A1 Aug. 19, 2004

(30) Foreign Application Priority Data

Feb. 17, 2003 (JP) ..... 2003-037928

(51) Int. Cl.
*B21D 43/05* (2006.01)

(52) U.S. Cl. ..... 72/405.16; 72/405.11; 72/405.01; 198/621.1; 414/751.1

(58) Field of Classification Search ..... 72/405.16, 72/405.13, 405.11, 405.01; 198/621.1; 414/751.1
See application file for complete search history.

(56) References Cited

U.S. PATENT DOCUMENTS 5,566,814 A * 10/1996 Hofele ..... 198/621.1
5,640,875 A * 6/1997 Horde et al. ..... 72/405.13
5,690,026 A * 11/1997 Thudium et al. ..... 100/207
5,934,125 A * 8/1999 Takayama ..... 72/1
6,109,087 A * 8/2000 Yoshii et al. ..... 72/405.16

FOREIGN PATENT DOCUMENTS

JP A-2000-061562 2/2000

* cited by examiner

*Primary Examiner*—Daniel C. Crane
(74) *Attorney, Agent, or Firm*—Rader, Fishman & Grauer, PLLC

(57) ABSTRACT

A small-sized feeding unit for a transfer press is provided. To this end, the feeding unit comprises: a feed box body one end of which is attached to side faces of uprights; feed driving means having servo motors disposed within the feed box body and pinions rotatively driven by the servo motors; feed racks movable in a feeding direction and meshing with the pinions respectively; feed carriers integrally attached to the feed racks respectively; and feed bars coupled to the feed carriers respectively so as to be movable at least either in a horizontal direction perpendicular to the feeding direction or in a vertical direction, wherein when the feed carriers are positioned at a stroke end on a press body side, the feed carriers are located in the vicinity of the feed driving means with respect to the feeding direction.

3 Claims, 8 Drawing Sheets

FEEDING UNIT FOR TRANSFER PRESS

TECHNICAL FIELD

The present invention pertains to a feeding unit for use in a transfer press.

BACKGROUND ART

Generally, transfer presses include a two-dimensional or three-dimensional transfer feeder and such transfer feeders have clamp units and a feeding unit. In the case of three-dimensional transfer feeders, lift units are further provided. More specifically, it is usually the case that a plurality of clamp units are mounted within the main body of the transfer press and that where a three-dimensional feeder is employed, a plurality of lift units are also mounted within the main body of the transfer press. The feeding unit is generally projectively mounted in the downstream side of the press body when viewed in a workpiece feeding direction.

FIGS. 7 and 8 are a side view showing a feeding stroke end (feeding end) condition of a prior art feeding unit and a side view showing a feed bar split condition of the feeding unit, respectively. This prior art feeding unit for a transfer press will be explained with reference to FIGS. 7, 8, while referring to FIG. 1 as a basic construction for a feeding unit for a transfer press, FIG. 1 showing a general side view of a transfer press according to the present invention.

In FIGS. 7 and 8, a feeding unit 105 (corresponding to a feeding unit 5 in FIG. 1) extends from the most upstream area to the most downstream area of the press machine and retains workpieces with fingers attached to two feed bars 4 that are opposed to each other in the front and rear direction of the press (i.e., the direction perpendicular to the workpiece feeding direction shown in the drawings). By moving the feed bars 4 two-dimensionally or three-dimensionally, the workpieces are successively conveyed to the next work station or idle station. A pair of uprights 3 (3') are provided in the most upstream and downstream areas and between every two slides 2 of the transfer press 1, so as to stand up on the bed. Each slide 2 moves up and down along slide guides (not shown) provided in the uprights 3 (3').

The feeding unit 105 has (i) a feed driving means 110 that includes servo motors 111 serving as a driving source for the feeding unit and pinions 112 rotatively driven by the servo motors 111; (ii) feed racks 120 that mesh with the pinions 112 and freely reciprocate in the workpiece feeding direction; (iii) feed carriers 130 integrally attached to the undersides of the feed racks 120; (iv) cylindrical coupling bars 131 that are disposed at the undersides of the feed carriers 130 so as to be movable in a clamping direction (i.e., the front and rear direction of the press) and have a central axis extending in a vertical direction; (v) a feed box body 140 for supporting these members; (vi) feed bars 4 each having one end coupled to the coupling bar 131 such that the feed bar 4 is movable in a lifting direction (i.e., vertical direction) and each supported by a clamp/lift unit 6 disposed between every right and left pair of uprights 3 (3') so as to move in the feeding direction; and (vii) fingers 7 detachably attached to the feed bars 4 for retaining the workpieces.

For off-line set-up of the fingers at the time of die replacement, each feed bar 4 has a detachable split section and a part of the feed bars 4 is placed on a moving bolster 8 so as to be carried out of the press together with the dies.

The feed box body 140 is cantilevered with one end being attached to the downstream outer side faces of the uprights 3 in order to avoid interference with a carry-out device disposed at the downstream area of the press and to achieve improved workability in carry-out of a workpiece.

In the prior art, the feed driving means 110 is, however, located in the vicinity of the leading end of the cantilevered feed box body 140, being a certain distance (the distance $L_2$ in FIG. 7) away from the uprights 3 as shown in FIGS. 7, 8. The feed driving means 110 is a heavy high-capacitance member composed of large-sized, extremely heavy servo motors and others and therefore the installation of the feed driving means 110 at a distance from the uprights 3 entails the following problems.

During forming of a workpiece, violent vibration occurs in the press body, so that the feed box body 140 receives forced vibration through its fixed end and therefore the feed bars 4, which are coupled to the feed box body 140 through the feed carriers 130, vibrate in turn. This causes a feeding error (conveying error), bringing the press machine to a sudden stop with the result that the machine utilization rate and productivity of the press machine drop. In some cases, the vibration of the feed box body 140 is reversely transmitted to the press body, which is a cause of a decrease in the accuracy of the workpiece forming operation. Further, the susceptibility to a workpiece feeding error and a decrease in the accuracy of the workpiece forming operation puts restrictions on workpiece feeding speed (i.e., the conveying speed of the feed bars) so that the production capacity of the press cannot be increased.

In addition, since the location of the feed box body 140 with respect to the feeding direction of the feed driving means 110 is in the vicinity of the stroke end of the feed carriers 130, the stroke end being located on the side opposite to the press body, when the feed carriers 130 are moved in the direction away from the press body, the end of each feed rack 120 projects from the feed box body 140. To prevent the feed racks 120 from being exposed, a rack cover is disposed at a side face of the feed box body 140. Since the rack cover for covering the projecting portions of the feed racks 120 is located at a level substantially equal to human head height, workability in taking-out of a workpiece by hand and in the maintenance of the parts in this area is impaired.

In addition, the entire length (length $L_{02}$ in FIG. 7) of the feeding unit 105 in the feeding direction and the size of the feeding unit 105 are significant. This not only increases the manufacturing cost of the feeding unit but also the entire length of the press, and as a result, the installation area of the press and the mechanical equipment cost increase.

As shown in FIGS. 7 and 8, the conventional feeding unit 105 has a stopper 161 at the feeding stroke end in the downstream area of the feeding unit 105, for preventing the driving motors from running out of control. Since this stopper 161 needs to be made of a large-sized cushioning material (e.g., rubber) in order to adsorb the kinetic energy of the movable part of the feeding unit 105 during run-away of the feeding unit and to mitigate its shocks, the stopper 161 is considerably thick in the feeding direction. The contact face of the stopper 161 is a certain distance away from the feeding end of the feed carriers 130 in the direction opposite to the press body, the distance corresponding to a bar splitting stroke. The stopper 161 is fixedly (permanently) attached to the underside of the feed box body 140 through a bracket 162. For keeping the installation space for the stopper 161, the entire length (length $L_{02}$ in FIG. 7) of the feeding unit 105 in the feeding direction becomes long and the feeding unit 105 becomes large in size. Therefore, not only the manufacturing cost of the feeding unit 105 but also the entire length of the press machine is increased, entailing an increase in the installation area of the press machine and the mechanical equipment cost.

The present invention has been made in consideration of the shortcomings described above and a primary object of the invention is therefore to provide a feeding unit for a transfer press, which is small in size so that the entire length of the press machine can be reduced, leading to reduced equipment cost.

DISCLOSURE OF THE INVENTION

The above object can be accomplished by a feeding unit for a transfer press according to a first aspect of the invention, the feeding unit comprising:

a feed box body one end of which is attached to side faces of uprights;

feed driving means having servo motors disposed within the feed box body and pinions rotatively driven by the servo motors;

feed racks supported by the feed box body so as to be movable in a feeding direction and meshing with the pinions respectively;

feed carriers integrally attached to the feed racks respectively; and feed bars coupled to the feed carriers respectively so as to be movable at least either in a horizontal direction perpendicular to the feeding direction or in a vertical direction, wherein when the feed carriers are positioned at a stroke end on a press body side, the feed carriers are located in the vicinity of the feed driving means with respect to the feeding direction.

According to the first aspect of the invention, since the feed carriers are located in the vicinity of the feed driving means with respect to the feeding direction when they are positioned at the stroke end on the press body side, the feed driving means, which is heavy in weight because it includes large-sized, extremely heavy servo motors and others, can be installed closely to the uprights. This is advantageous, in view of strength, for the cantilevered feed box body that supports the feed driving means. Therefore, even when performing workpiece forming operation in which vibration occurs in the press body, the vibration of the feed box body caused by the vibration of the press body can be restricted, thereby eliminating the previous fear that a workpiece feeding error might occur owing to the vibration of the feed bars and the press machine might be brought to a stop owing to a feeding error, leading to a decrease in the machine utilization rate as well as in productivity. Further, the speed of workpiece conveyance becomes free from constraints by the possibility of workpiece feeding errors so that an improvement in the productivity of the press can be expected.

Since the feed racks to which the feed carriers are attached mesh with the pinions of the feed driving means respectively, the feed racks are designed to have length equal to the length of the moving stroke of the feed carriers plus some allowance. In addition, the feed box body is designed to have length equal to the space for accommodating the feed carriers and the stopper when the feed carriers are positioned at the stroke end on the side opposite to the press body in the feeding direction plus some allowance.

Therefore, when the feed carriers are positioned at the stroke end on the side opposite to the press body in the feeding direction, the feed racks are fit in the feed box body, so that the rack cover can be eliminated from the feed box body, the rack cover being a projecting part located at a level substantially equal to human head height. As a result, improved workability can be achieved in taking-out of a workpiece by hand and in the maintenance of the feeding unit.

Additionally, the feeding unit can be made small, which reduces not only the production cost of the feeding unit but also the entire length of the press with the result that installation area for the press and mechanical equipment cost can be saved.

According to a second aspect of the invention, there is provided a feeding unit for a transfer press, the feeding unit comprising:

a feed box body one end of which is attached to side faces of uprights;

feed driving means having servo motors disposed within the feed box body and pinions rotatively driven by the servo motors;

feed racks supported by the feed box body so as to be movable in a feeding direction and meshing with the pinions respectively;

feed carriers integrally attached to the feed racks respectively; and feed bars coupled to the feed carriers respectively so as to be movable at least either in a horizontal direction perpendicular to the feeding direction or in a vertical direction, wherein when the feed carriers are positioned at a stroke end on a press body side, the feed racks projects with one end closer to a slide than the outer side faces of the uprights are, the outer side faces being located on a feed box body side.

According to the second aspect of the invention, when the feed carriers are positioned at the stroke end on the press body side, each feed carrier projects such that its one end is closer to the slide than the outer side faces of the uprights are, the outer side faces being located on the feed box body side. Therefore, the degree to which the stroke end projects to the side opposite to the press body can be reduced without fail (it is possible in some cases to disallow the stroke end to project). Accordingly, the projecting amount of the rack cover which projects from the feed box body side can be reduced or eliminated so that improved workability can be achieved in taking-out of a workpiece by hand and in the maintenance of the feeding unit.

Additionally, the feeding unit can be made small, which reduces not only the production cost of the feeding unit but also the entire length of the press with the result that installation area for the press and mechanical equipment cost can be saved.

The feed driving means can be positioned closer to the uprights by moving the positions of the whole feed racks toward the press body side, whereby the same effect as that of the first aspect of the invention can be achieved.

According to a third aspect of the invention, there is provided a feeding unit for a transfer press, the feeding unit comprising:

a feed box body one end of which is attached to side faces of uprights;

feed racks supported by the feed box body so as to be movable in a feeding direction and driven in the feeding direction by feed driving means disposed within the feed box body;

feed carriers integrally attached to the feed racks respectively; and feed bars coupled to the feed carriers respectively so as to be movable at least either in a horizontal direction perpendicular to the feeding direction or in a vertical direction, wherein a stopper for restricting the stroke end of the feed carriers on a side opposite to a press body is disposed so as to be retractable from a stroke zone of the feed carriers between the feed carriers and the feed box body.

According to the third aspect of the invention, as a measure for inhibiting the run-away of the feed bars in the feeding direction during workpiece conveying operation, a stopper for restricting the stroke end of the feed carriers on the side opposite to the press body is disposed so as to be retractable from the stroke zone of the feed carriers. During die replacement, this stopper is retracted, thereby ensuring the stroke of splitting the feed bars. Usually, the movable stopper is made of a large-sized (thick) cushioning material in order to obtain buffering ability for absorbing the kinetic energy of the movable part of the feeding unit even when the feeding unit runs out of control at the maximum speed in the feeding direction.

In the third aspect of the invention, it is preferable to provide, apart from the above stopper, a relatively thin, fixed type stopper used for die replacement.

The fixed stopper used for die replacement can be made of a thin cushioning material because the movement of the feed bars is slow during die replacement. Therefore, despite the use of the large-sized stopper, the length of the feed box body is increased by only the amount substantially equal to the thickness of the thin cushioning material used for die replacement, so that the entire length of the feeding unit can be shortened. As a result, the feeding unit can be made small and the entire length of the transfer press can be reduced.

BEST MODE FOR CARRYING OUT THE INVENTION

Referring now to the accompanying drawings, a feeding unit for a transfer press will be concretely described below according to a preferred embodiment of the invention.

Figure 1:
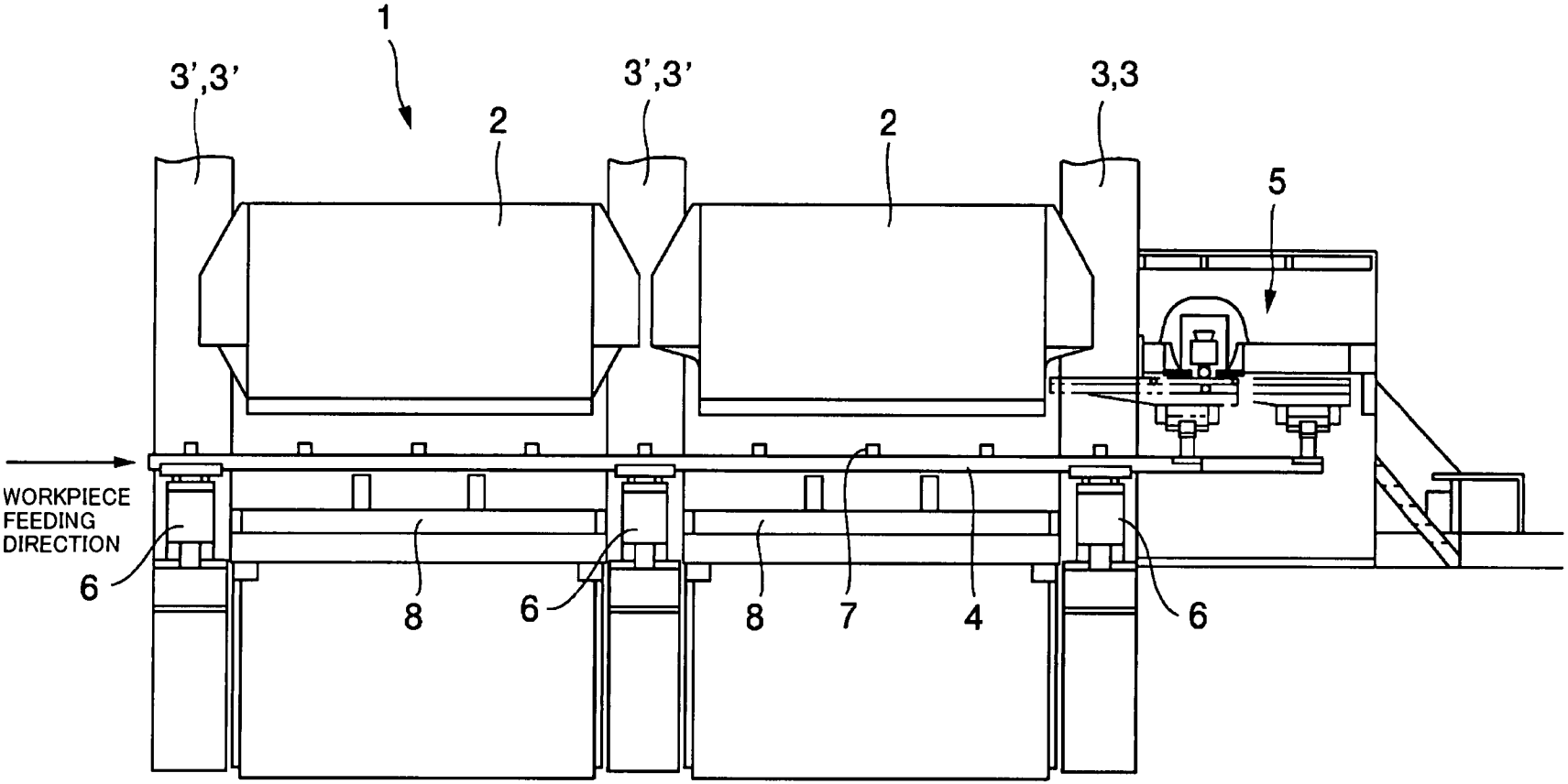
FIG. 1 is a general side view of a transfer press according to an embodiment of the invention.

With reference to FIG. 1 which is a general side view of a transfer press according to the embodiment of the invention, the feeding unit of this embodiment will be outlined.

In this embodiment, a feeding unit 5 extends from the most upstream area to the most downstream area of the press machine and is designed such that workpieces are held by fingers 7 on two feed bars 4 which are opposed to each other in the front and rear direction of the press machine (i.e., the direction perpendicular to the plane of the drawing), and such that the workpieces are successively transferred to the next work station or idle station through two-dimensional or three-dimensional movement of the feed bars 4. A pair of uprights 3 (3') are disposed between every two slides 2 as well as in the most upstream and downstream areas of the transfer press 1 so as to stand up on a bed. Each slide 2 moves up and down along slide guides (not shown) respectively provided in the uprights 3(3').

Figure 2:
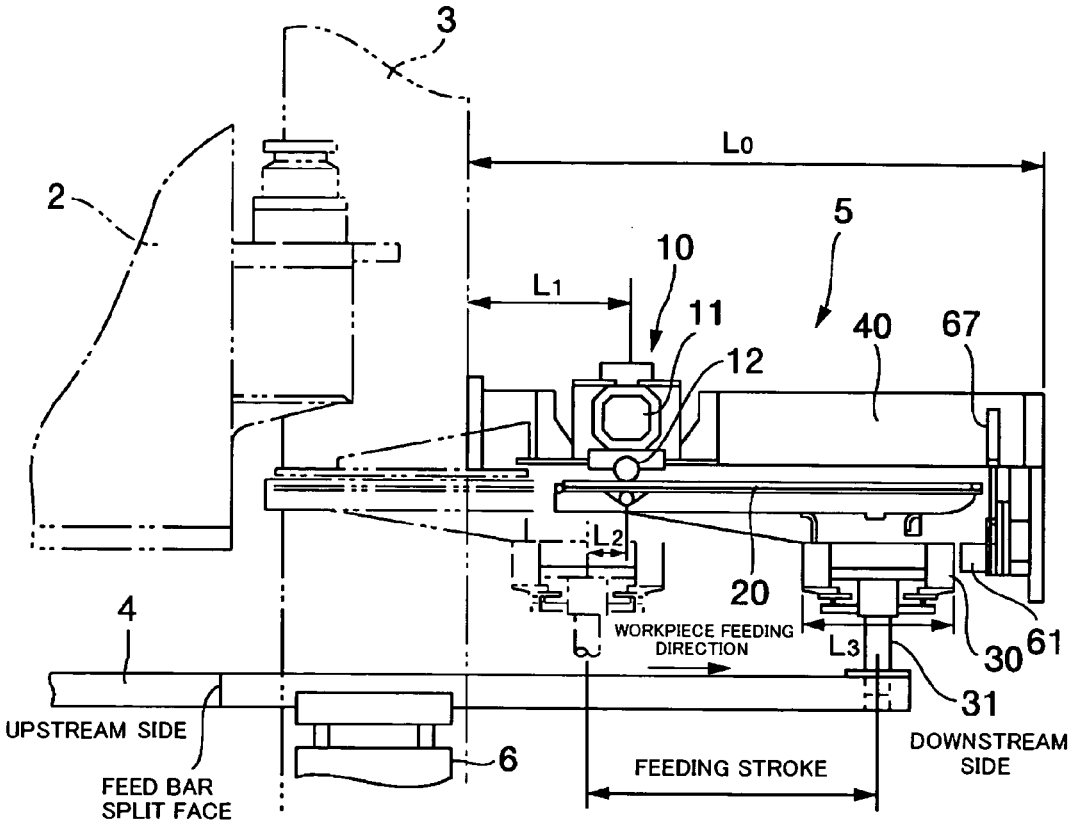
FIG. 2 is a side view showing a feeding end condition of the feeding unit according to the embodiment of the invention.
Figure 3:
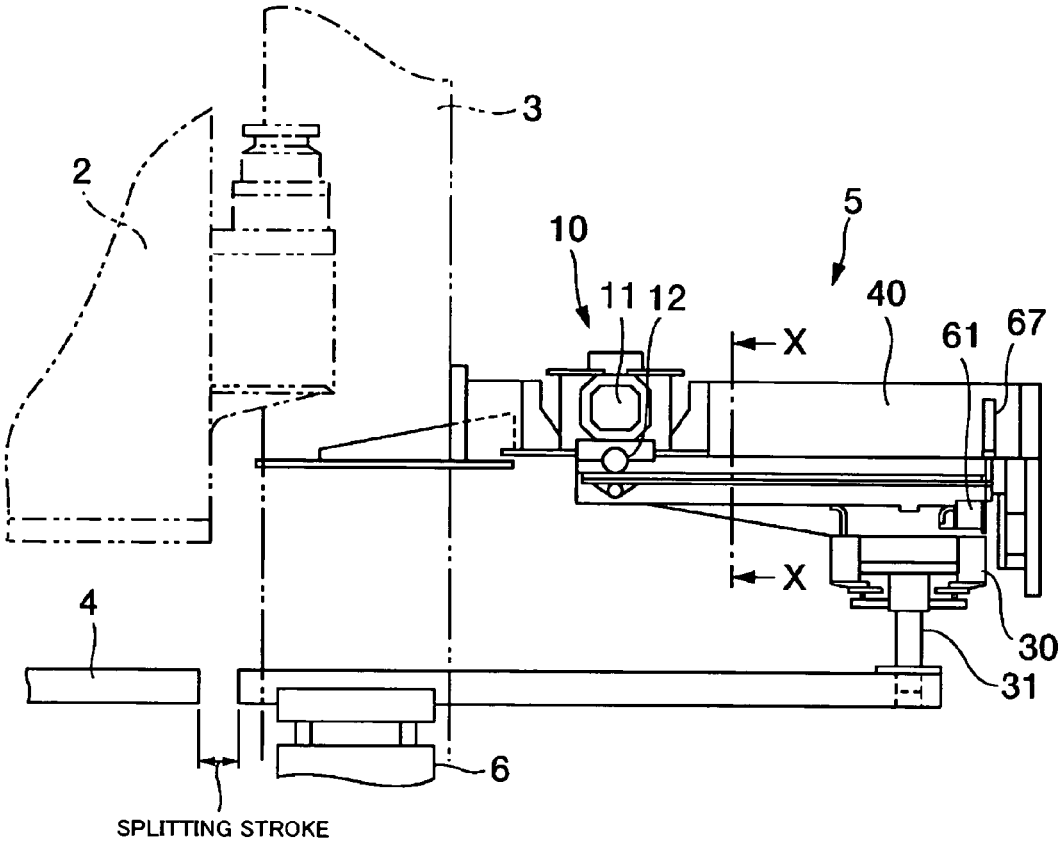
FIG. 3 is a side view showing a feed bar split condition of the feeding unit according to the embodiment of the invention.

Reference is made to FIGS. 2 to 6 to describe the feeding unit of this embodiment in detail. FIGS. 2 and 3 are side views showing a feeding end condition and feed bar split condition, respectively, of the feeding unit according to the present embodiment.

The feeding unit 5 has a feed driving means 10, feed racks 20, feed carriers 30, coupling bars 31, a feed box body 40 for supporting these members, the feed bars 4 and the fingers 7.

The end of the feed box body 40 on the side of the press body is attached to outer side faces of the uprights 3 (these outer side faces face in a feeding direction), in order to avoid an interference with a carry-out system (not shown) disposed on the downstream side of the feeding unit 5 and to achieve improved workability in taking-out of a workpiece. With this arrangement, the feeding unit 5 is supported in a cantilevered fashion.

The feed driving means 10 is a driving source for the feeding unit 5 and comprises a right and left pair of servo motors 11 attached to the feed box body 40 and a right and left pair of pinions 12 rotatively driven by the right and left servo motors 11 respectively, through a specified power transmission mechanism described later. (It should be noted that "right and left" used hereinbefore and hereinafter are based on the feeding direction). The right and left pair of servo motors 11 move the heavy movable part of the feeding unit 5 at high speed together with the workpieces, and therefore, they usually have high output power and are large-sized and heavy in weight. Under the feed box body 40, a right and left pair of feed racks 20 which mesh with the right and left pair of pinions 12 respectively are supported so as to be movable in the feeding direction. Integrally attached to the undersides of the right and left pair of feed racks 20 are the right and left pair of feed carriers 30.

The right and left pair of feed carriers 30 support cylindrical coupling bars 31 respectively so as to be movable in a clamping direction, each coupling bar 31 having a vertically extending central axis (a horizontal direction perpendicular to the feeding direction is hereinafter referred to as "clamping direction"). An end of each feed bar 4 on the side opposite to the press body is fitted on its associated coupling bar 31 such that the feed bar 4 can be freely lifted and lowered. Each feed bar 4 is supported by a clamp/lift system 6 disposed between every right and left pair of uprights 3 such that the feed bar 4 can freely move in the feeding direction. Each clamp/lift system 6 is provided with a clamp driving means and lift driving means (not shown) to drive the supported parts of the right and left feed bars 4 in the clamping direction and a lifting direction.

Detachably mounted on the right and left pair of feed bars 4 are the fingers 7 for retaining the workpieces.

For off-line set-up of the fingers 7 at the time of die replacement, each feed bar 4 has a detachable split section and a part of the feed bar 4 is placed on a moving bolster 8 so as to be carried out of the press together with the dies.

In the present embodiment, while the feed box body 40 is attached to the side faces of the uprights 3 in a cantilevered fashion as described earlier, the feed driving means 10 is positioned closer to the upright 3 (the distance from the feed driving means 10 to the uprights 3 is indicated by $L_1$ in FIG. 2) in order that when the feed carriers 30 are positioned at the stroke end on the press body side, they are located in the vicinity of the feed driving means 10 with respect to the feeding direction.

For making the feed driving means 10 close to the uprights 3 and setting the length of the feed racks 20 to a size having a limited allowance, it is preferable to position the pinions 12 of the feed driving means 10 within the width $L_3$ of the feed carriers 30 with respect to the feeding direction.

Figure 4:
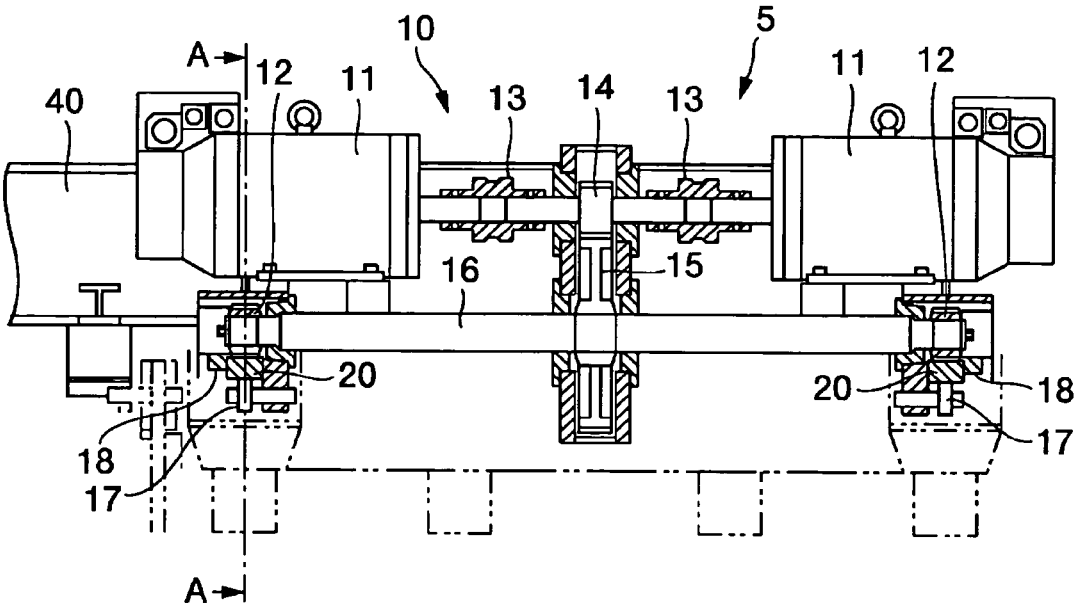
FIG. 4 is a view (partly sectional view) taken along line X—X of FIG. 3.
Figure 5:
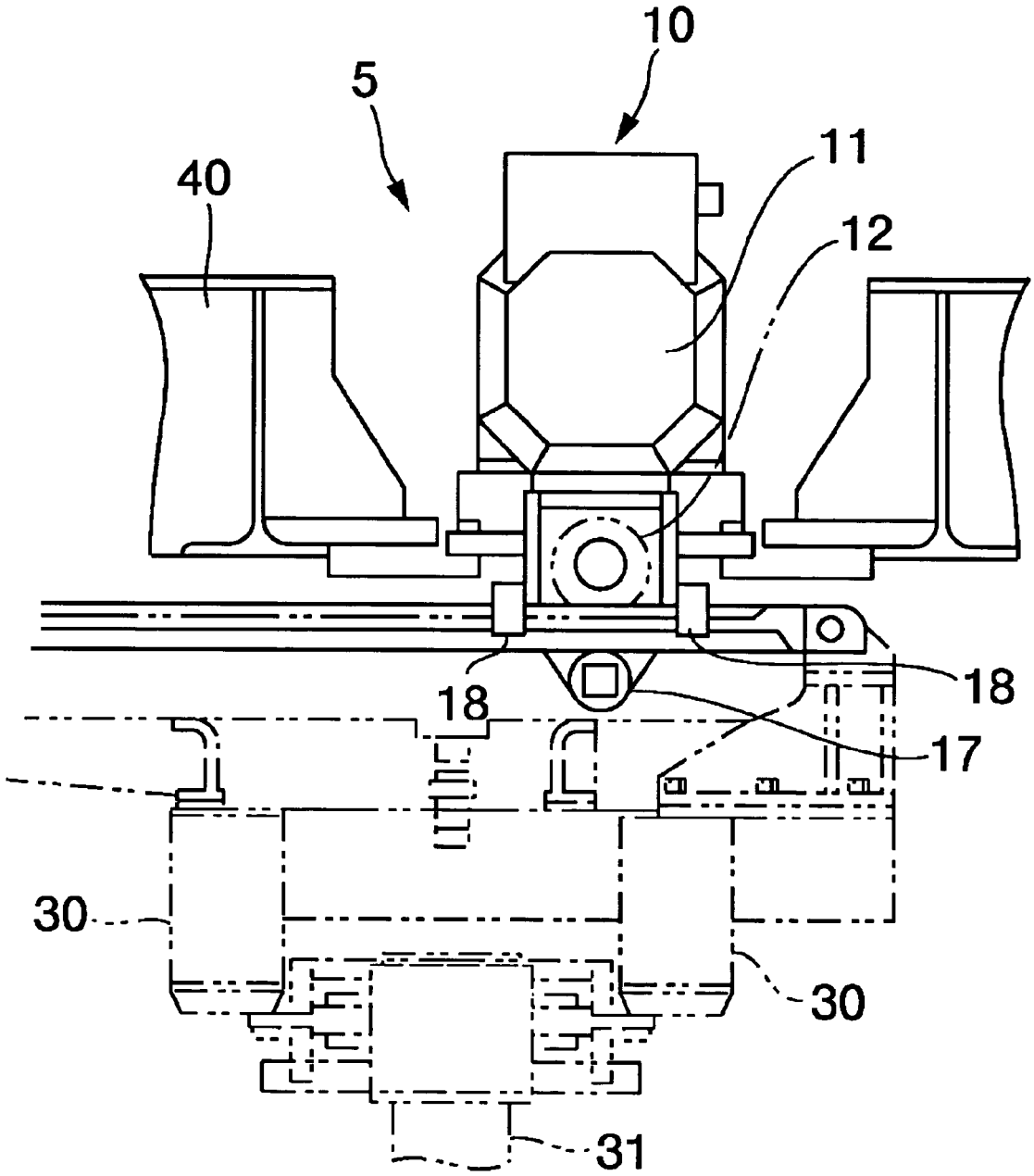
FIG. 5 is a view taken along line A—A of FIG. 4.

Next, the feed driving means 10 will be described in detail with reference to FIGS. 4 and 5. FIGS. 4 and 5 are a view (partly sectional view) taken along line X—X of FIG. 3 and a view taken along line A—A of FIG. 4, respectively.

In the present embodiment, the right and left pair of servo motors 11 are mounted on the feed box body 40, and the shaft ends of these servo motors 11 are coupled to a first gear 14 by couplings 13 respectively, the first gear 14 being positioned at the substantial center of the space between the servo motors 11. A pinion drive shaft 16 having an axis extending in a lateral direction is rotatively supported by the feed box body 40. A second gear 15 attached to the substantial center of the pinion drive shaft 16 with respect to the lateral direction meshes with the first gear 14. Further, the right and left pair of pinions 12, which are attached to the right and left shaft ends of the pinion drive shaft 16 respectively, are engaged with the two feed racks 20 respectively so as to be movable in the feeding direction. The feed carriers 30, which are integrally attached to the two feed racks 20 respectively, are each provided with a first guide roller 17 and a second guide roller 18. The first guide rollers 17 guide the two feed racks 20 respectively in a vertical direction whereas the second guide rollers 18 guide the feed racks 20 respectively in a back and forth direction.

The source for feed driving is composed of the two small-sized servo motors 11 with a view to avoiding use of a costly high-capacity motor, reducing installation space, and in addition, improving the weight balance of the feeding unit 5 with respect to the front and rear direction of the press (i.e., the direction perpendicular to the feeding direction). It should be noted that the effect of reducing the load imposed on the feed box body 40 can be achieved with one servo motor 11 for feed driving, by setting the mounting position of the feed driving means 10 closer to the uprights 3.

The reason for the provision of the two feed racks 20 disposed on the right and left sides is that since these feed racks 20 have the function of guiding the movement of the feed carriers 30 as well as the feed driving function, the movement in the feeding direction can be smoothly carried out.

With the arrangement described above, the heavy feed driving means 10 comprised of the extremely heavy, large-sized servo motors 11 is disposed closely to the uprights 3 and therefore the load imposed on the feed box body 40 which is a support medium for the feed driving means 10 can be reduced. As a result, even when performing workpiece forming/pressing operation, the vibration of the feeding unit 5 and the feed bars 4 due to the vibration of the press body 1 does not occur and therefore the vibration of the entire press machine does not increase, which eliminates the previous fear that the accuracy of the workpiece forming operation might be adversely affected and the press machine might be brought to a stop owing to a workpiece feeding error attributable to the vibration of the feed bars 4.

Further, the speed of workpiece conveyance becomes free from constraints by the possibility of a decrease in the accuracy of workpiece forming operation and workpiece feeding errors so that an improvement in the productivity of the press can be expected.

According to the present embodiment, when the feed carriers 30 are at the stroke end on the side opposite to the press body, the ends of the feed racks 20 of the feeding unit 5 do not project from the end of the feed box body 40 in the direction opposite to the press body. Therefore, the need for a rack cover 9, which is a projecting part located at a level substantially equal to human head height, can be eliminated. As a result, improved workability in taking-out of a workpiece by hand and in the maintenance of the feeding unit 5 can be achieved.

Additionally, by allowing the feed racks 20 to project with their ends closer to the slide than the outer side faces of the uprights 3 on the feed box body side are when the feed carriers 30 are positioned at the stroke end on the press body side, the degree to which the feed racks 20 project from the end of the feed box body 40 can be reduced without fail when the feed carriers 30 move to the stroke end on the side opposite to the press body. Therefore, the effect described earlier can be attained.

Further, the feeding unit 5 can be made small because the length of the feeding unit 5 in the feeding direction (i.e., length $L_0$ in FIG. 2) can be reduced by the amount corresponding to the length of the eliminated feed box body's portion projecting toward the side opposite to the press body, which reduces not only the production cost of the feeding unit 5 but also the entire length of the press with the result that installation area for the press and mechanical equipment cost can be saved.

While the present embodiment has been described with the feed bars 4 that can be freely lifted and clamped, the invention is not limited to this but applicable to a case where the feed bars 4 can be either freely lifted or freely clamped.

Next, the stopper section of the feeding unit will be described with reference to FIG. 6 that is an enlarged side view showing the movable stopper section of the feeding unit according to the present embodiment and FIGS. 2, 3 that show the operational relationship between the feed carriers 30, a first stopper 61 and a second stopper 62.

Figure 6:
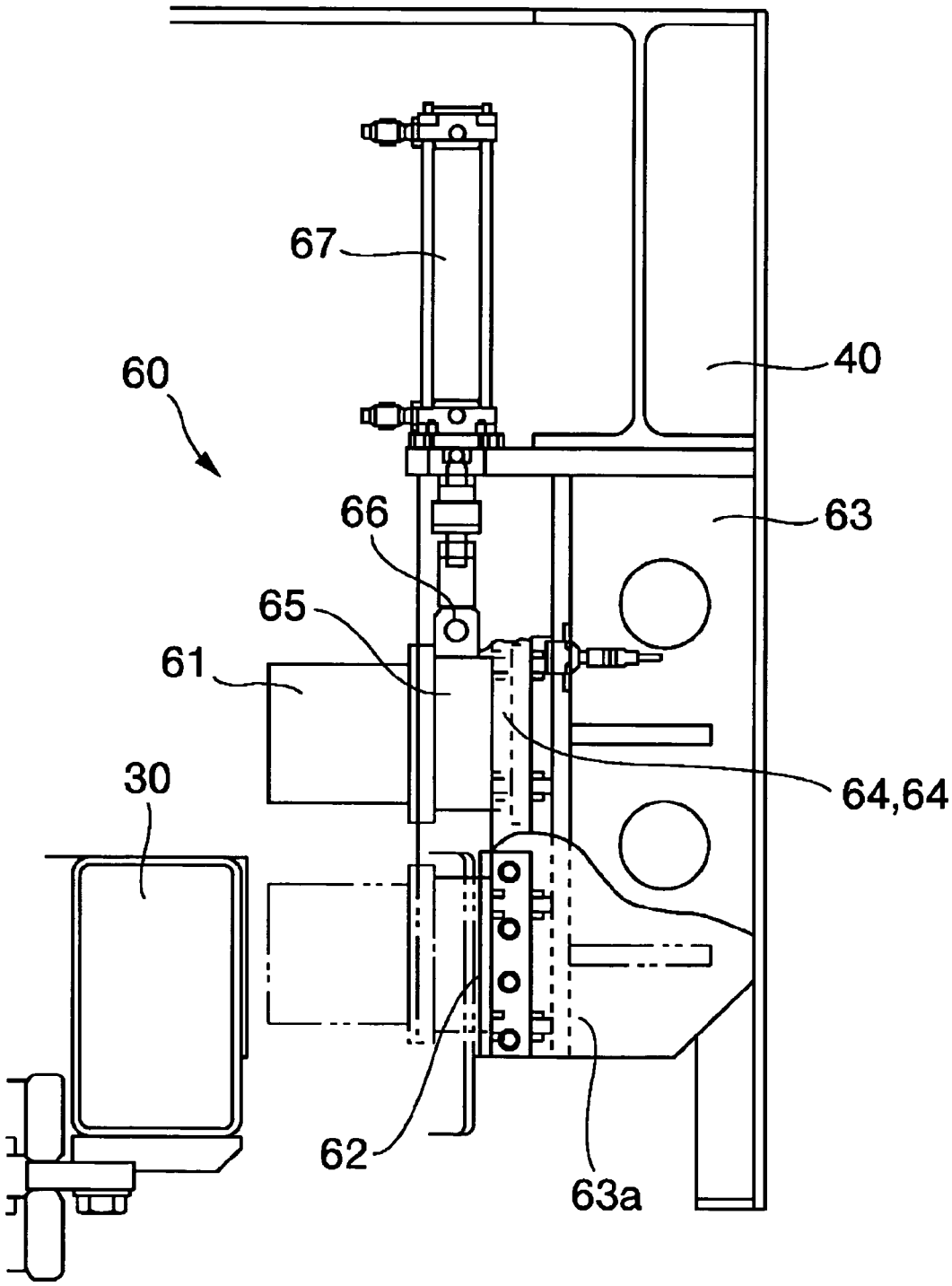
FIG. 6 is an enlarged side view showing a movable stopper section of the feeding unit according to the embodiment of the invention.
Figure 7:
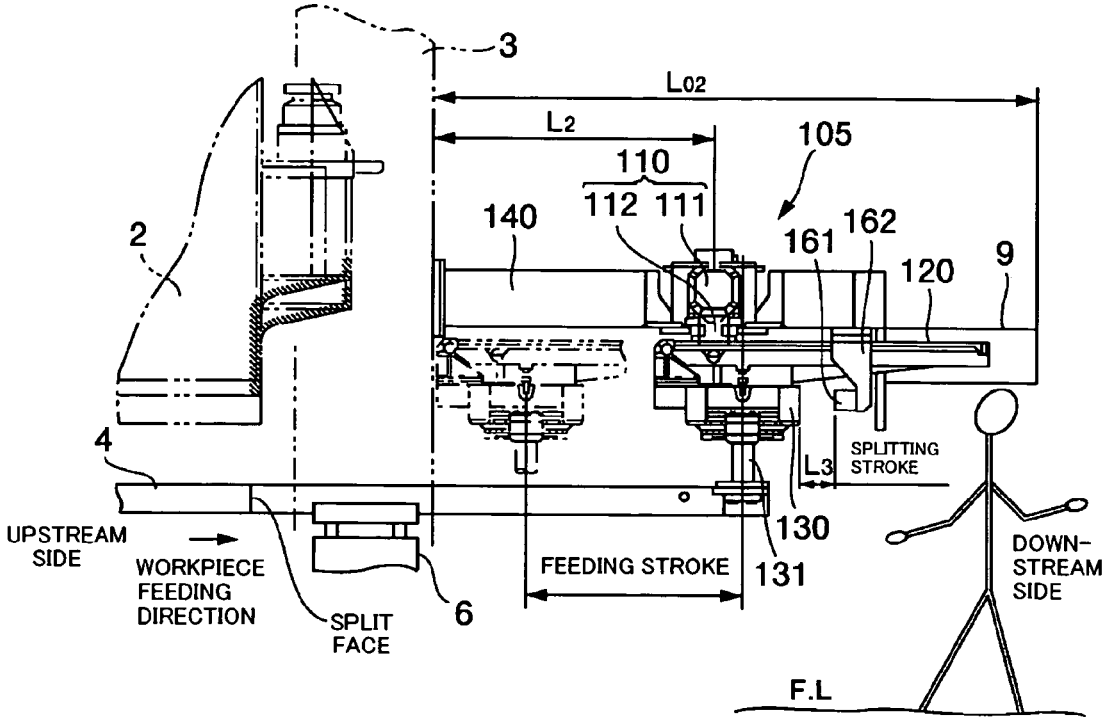
FIG. 7 PRIOR ART
FIG. 7 is a side view showing a feeding end condition of a feeding unit according to a prior art technique.
Figure 8:
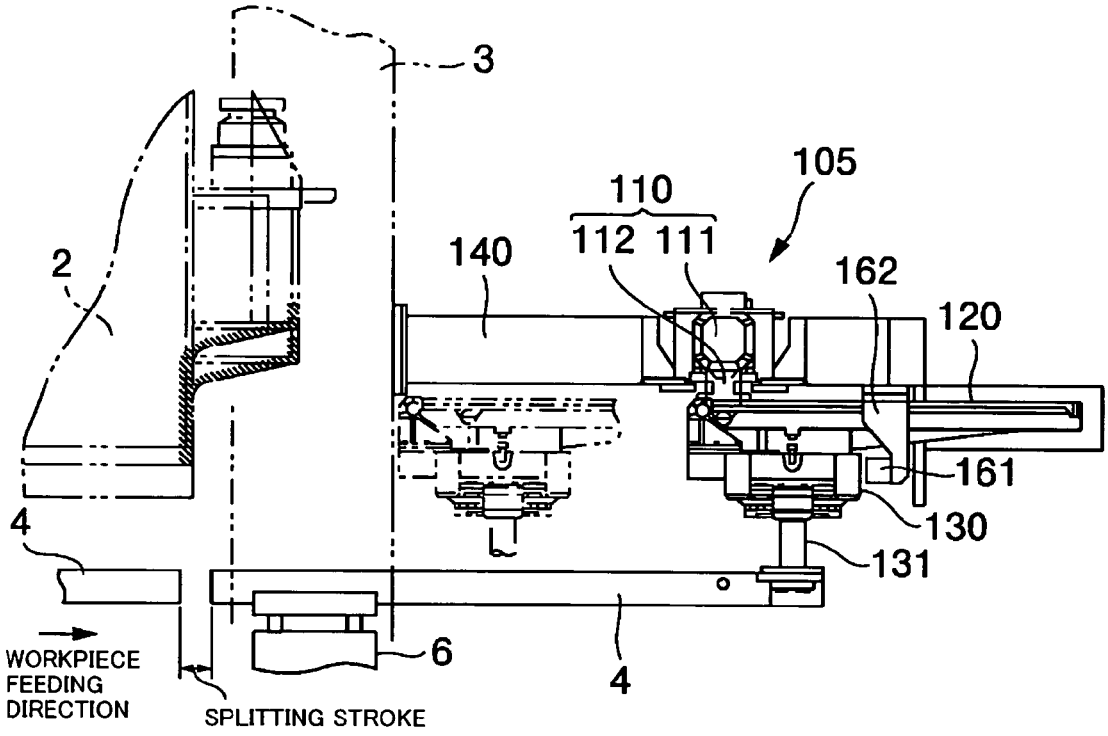
FIG. 8 PRIOR ART
FIG. 8 is a side view showing a feed bar split condition of the feeding unit according to the prior art technique.

In FIG. 6, a bracket 63 is attached to the underside of the end of the feed box body 40 on the side opposite to the press body and an air cylinder 67 is attached to the bracket 63. A slider 65 is attached to the rod leading end of the air cylinder 67 through a pin 66 so as to be vertically movable along a right and left pair of slide guides 64 (which are aligned in a direction perpendicular to the plane of FIG. 6) attached to the bracket 63. Attached to the face of the slider 65 on the side of the feed carrier 30 is the first stopper 61. Attached to a side face of the bracket 63 is a bracket **63*a* for covering the side faces of the right and left pair of slide guides 64. Attached to the leading end of the bracket 63*a* is the permanently disposed second stopper 62 which is positioned so as to project with its end closer to the feed carriers 30 than the slide guides 64 are, avoiding the stroke zone of the first stopper 61**.

The first stopper 61 is made from a large-sized cushioning material (e.g., rubber) in order to absorb the kinetic energy of the movable part of the feeding unit 5 in the event of unexpected run-away of the feeder during feeding of the workpieces at high speed and in order to mitigate the shock to prevent damage to the feeding unit 5, the feed bars 4 and others.

The second stopper 62 restricts the stroke end of the feed carriers 30 during their movement at a relatively slow speed, while the feed bars 4 being in the split condition. The kinetic energy of the movable part of the feeding unit 5 and the shock occurring when the second stopper 62 comes into contact are insignificant, and therefore, the second stopper 62 may be thin in the feeding direction provided that it has rigidity. In this embodiment, the second stopper 62 is made from a steel material.

Next, there will be described the operation and function of a movable stopper section 60 having the structure described above.

During the normal processing operation of the press, the first stopper 61 is moved to a lower end position (designated by imaginary line in FIG. 6) by the air cylinder 67 as shown in FIG. 2 and kept at this position to serve as a stopper for the stroke end of the feed carriers 30 on the side opposite to the press body.

For off-line set-up of the dies and the fingers 7 during die replacement, the feed bars 4 need to be split into two portions (i.e., bar splitting), that is, a portion to be placed on the moving bolster 8 and a portion to be left within the press. To assure the splitting stroke necessary for splitting of the feed bars 4, the first stopper 61 is moved to an upper end position (indicated by solid line in FIG. 6) by the air cylinder 67 as shown in FIG. 3 and kept at this position, whereby the first stopper 61 is retracted from the stroke zone of the feed carriers 30 which are coupled to the feed bars 4 through the coupling bars 31 respectively and thus, the splitting stroke for the feed bars 4 is ensured. When the feed bars 4 are in their split condition, the second stopper 62, which is thin and fixedly, permanently attached to the bracket 63, is used as a stopper in place of the first stopper 61.

The stopper associated with this embodiment is designed to ensure the splitting stroke for the feed bar 4 by retracting the first stopper 61 made of a large-sized cushioning material from the stroke zone of the feed carriers 30 during die replacement, and therefore the length of the feed box body 40 in the feeding direction can be shortened by the amount corresponding to the thickness of the first stopper 61, so that the entire length of the feeding unit 5 can be reduced. The present embodiment has been described with a case where the first stopper 61 is retracted to be replaced by the thin, second stopper 62, and in this case, the length of the feed box body 40 in the feeding direction can be reduced by the amount corresponding to the difference in thickness between the first stopper 61 and the second stopper 62, so that the same effect can be attained. Accordingly, the feeding unit 5 can be made small, which reduces not only the production cost of the feeding unit but also the entire length of the press machine with the result that installation area for the press machine and mechanical equipment cost can be saved.

Although the moving direction of the movable stopper is a vertical direction in the foregoing embodiment, the invention is not limited to this but applicable to cases where the movable stopper is movable in a lateral direction or alternatively pivotable either in a vertical or in lateral direction, upon condition that the movable stopper can retract from its normal operating position during die replacement.

The feeding unit 5 of the present embodiment can achieve the following effect.

In the feeding unit 5, since the feed driving means 10 is disposed in the vicinity of the possible closest position to the uprights 3, the heavy feed driving means 10 can be positioned closely to the upright 3, which is beneficial for the cantilevered feed box body 40 in view of strength. With this arrangement, even when performing workpiece forming operation in which vibration occurs in the press body, the vibration of the feeding unit 5 and the feed bars 4 due to the vibration of the press body can be restricted. This eliminates the previous fear that a workpiece feeding error due to the vibration of the feed bars 4 might occur and the press machine might be brought to a stop owing to a workpiece feeding error, resulting in a decreased machine utilization rate and decreased productivity.

Further, the speed of workpiece conveyance becomes free from constraints by the possibility of workpiece feeding errors and the like so that an improvement in the productivity of the press can be expected.

When the feed carriers 30 are positioned at the stroke end on the side opposite to the press body in the feeding direction, the feed racks 20 are fitted in the feed box body 40 so that no protrudent parts project from the feed box body 40 at a level substantially equal to human head height. This contributes to an improvement in workability in taking-out of a workpiece by hand and in the maintenance of the feeding unit.

Further, since the length of the feeding unit 5 in the feeding direction can be shortened by the above arrangement, the feeding unit 5 can be made small, which reduces not only the production cost of the feeding unit but also the entire length of the press machine with the result that installation area for the press machine and mechanical equipment cost can be saved.

In the present embodiment, during normal operation, the first stopper 61 made of a large-sized (thick) cushioning material is used as a stopper for restricting the stroke end of the feeder in the event of run-away, and during die replacement, the first stopper 61 is retracted from the stroke zone of the feed carriers 30 in order to obtain the stroke necessary for splitting of the feed bars. With this arrangement, the length of the feed box body 40 in the feeding direction can be shortened by the amount corresponding to the thickness of the first stopper 61, resulting in a reduction in the entire length of the feeding unit 5. Further, when the feed bars 4 are in their split condition, the permanently disposed second stopper 62 is used in place of the first stopper 61 and the second stopper 62 is small in size, so that the entire length of the feeding unit 5 can be reduced by the amount corresponding to the difference between the first stopper 61 and the second stopper 62. As a result, the feeding unit 5 can be made small while ensuring its rigidity, and the entire length of the transfer press 1 can be shortened.

What is claimed is:

1. A feeding unit for a transfer press comprising:

a feed box body one end of which is attached to side faces of uprights and extending longitudinally therefrom to terminate at a distance L;

feed driving means having servo motors disposed within the feed box body and pinions rotatively driven by the servo motors;

feed racks supported by the feed box body so as to be movable in a feeding direction and meshing with the pinions respectively, each feed rack having an upstream end disposed adjacent the uprights and an opposite downstream end;

feed carriers integrally attached to the feed racks respectively; and feed bars coupled to the feed carriers respectively so as to be movable at least either in a horizontal direction perpendicular to the feeding direction or in a vertical direction, wherein said feed driving means is positioned in the vicinity of the uprights in the feeding direction with respect to the feed carriers positioned at a stroke end on the side opposite to a press body and wherein the downstream ends of the feed racks are positioned interiorly of the distance L when the feed carriers are positioned at the stroke end.

2. The feeding unit for a transfer press according to claim 1, wherein when the feed carriers are positioned at a stroke end on a press body side, the feed carriers are located in the vicinity of the feed driving means with respect to the feeding direction.

3. The feeding unit for a transfer press according to claim 1, wherein each one of the uprights has an outer side face and when the feed carriers are positioned at the stroke end on a press body side, the feed racks project with one end closer to the press body than the outer side faces of the uprights, the outer side faces being located on a feed box body side.

* * * * *